United States Patent [19]

Weldy

[11] Patent Number: 5,048,247

[45] Date of Patent: Sep. 17, 1991

[54] ARCH CORNER BEAD

[76] Inventor: Michael D. Weldy, 1320 Dewey Pl., Campo, Calif. 92006

[21] Appl. No.: 436,073

[22] Filed: Nov. 13, 1989

[51] Int. Cl.[5] ..... B32B 3/26; B32B 1/04

[52] U.S. Cl. ..... 52/255; 52/417; 428/61; 428/156; 428/174; 428/188; 264/177.17

[58] Field of Search ..... 428/61, 188, 98, 156, 428/174; 52/255, 288, 417; 248/345.1; 264/177.17

[56] References Cited

U.S. PATENT DOCUMENTS

| | | | |
|---|---|---|---|
| 2,311,345 | 2/1943 | Mitchell | 52/255 |
| 4,863,774 | 9/1989 | Tucker | 52/417 |

FOREIGN PATENT DOCUMENTS

| | | | |
|---|---|---|---|
| 598431 | 5/1960 | Canada . | |
| 858168 | 12/1970 | Canada . | |
| 3238312 | 3/1984 | Fed. Rep. of Germany . | |
| 2056523 | 3/1981 | United Kingdom | 52/255 |

*Primary Examiner*—Alexander S. Thomas

*Attorney, Agent, or Firm*—Brown, Martin, Martin & McClain

[57] ABSTRACT

An elongated "L" shaped plastic drywall corner strip containing two flat legs joined to form an acute angle, one of which is kerfed repeatedly to increase flexibility and allow installation over inside and outside arches, the outside of the legs having a surface to which joint compound adheres, and a solid bead overarching and/or interior arching the point of junction of the legs.

20 Claims, 2 Drawing Sheets

ARCH CORNER BEAD

BACKGROUND OF THE INVENTION

1. Field of the Invention

This invention deals with an extrudable plastic drywall corner strip, commonly called a corner bead, suitable for reinforcing corners of arches. The exposed surfaces of the strip having a finish suitable to allow joint compound to adhere to it.

2. Description of Related Art

Metal corner beads have been in use for a long time in the drywall application industry. Generally, these beads are formed from tin by taking a long tin strip and bending it longitudinally along its center to form a hollow raised bead and two straight legs. The inside angle of such a bead is generally just under 90°.

In order to form an arch, having either an outside or inside curve without buckling and kinking, slits are cut with tin snips repeatedly in one of the flat legs. The corner formed by such a modified tin bead is unsatisfactory because the hollow bead tends to kink or tear, creating an angular effect, with alternating kinks and flat spots. In order to prevent this kinking, the slits can be cut so that they do not reach the bead. This, however, is still unsatisfactory, because the tin tends to tear along shear lines created by stress when trying to force the bead around a curve. Using ordinary tin snips for cutting slits causes the metal to curl, resulting in a poor uneven surface for applying joint compound. Tin strips are also difficult to nail to the drywall because the final hammer blows cause permanent deformation.

Plastic strips containing a hollow head are commercially available. Although these strips are more efficacious in forming nailable tabs when slits are cut, the hollow raised bead does not address the problems of kinking and tearing when force is applied to form arches.

It would be desirable, therefore, to have strips made from some type of resilient material, which will not permanently deform when suffering a blow, which is flexible but sufficiently tensile to form a smooth curve, and which is textured so as to hold a joint compound applied to the corners.

SUMMARY OF THE INVENTION

In order to overcome some of the above mentioned disadvantages associated with existing metal and plastic corner beads, when applied to arches, an elongated "L" shaped plastic drywall corner strip is described, which is kerfed repeatedly to increase flexibility, and which contains a solid raised bead overarching the junction of its two flat legs which form an acute angle, the solid bead being resistant to tearing and permanent deformation caused by pressure or hammer blows.

An objective satisfied by this invention is the provision of a drywall corner strip suitable for reinforcing corners of arches, comprising an elongated "L" shaped plastic strip having two flat legs, the legs joined to form an acute inside angle, and containing a substantially cylindrical solid bead formed in continuum with the legs at the junction so formed. One of the legs contains a plurality of spaced kerfs, providing a means for the strip to follow curves without buckling, tearing or overlapping. The outside surfaces of the legs have a surface means to adhere to joint compound.

Also part of this invention is a method of producing a drywall corner strip suitable for reinforcing corners of arches, comprising extruding and elongated "L" shaped plastic strip having two flat legs joined to form an acute inside angle, and containing a substantially cylindrical solid bead in continuum with the legs at the junction of said angle, cutting a plurality of spaced kerfs in one of the legs, thereby providing a means for the strip to follow curves without buckling, tearing or overlapping, and providing a surface means to adhere to joint compound on the outside surface of said legs.

Thus, a solid corner bead is formed which is structurally superior to hollow corner beads presently in use commercially, because it resists kinking, forming flat spots and permanent deformation upon cutting or receiving a blow.

Still, further objects and advantages of this invention will become apparent to those skilled in the art upon reading the entire disclosure contained herein.

DESCRIPTION OF THE PREFERRED EMBODIMENT

Figure 1:
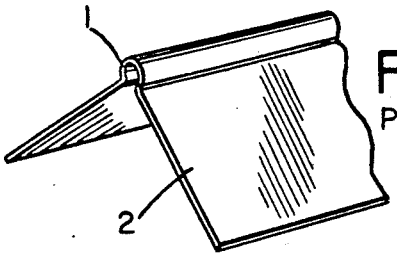
FIG. 1 PRIOR ART
FIG. 1 illustrates a portion of a typical prior art corner bead.

FIG. 1 portrays a commercially available corner bead, either metal or plastic, which is seen to have a hollow bead 1 at the junction of the flat legs 2. As referred to above, such a hollow bead does not provide the strength or flexibility required to reinforce a drywall corner forming an arch or curve without kinking or tearing.

Figure 2:
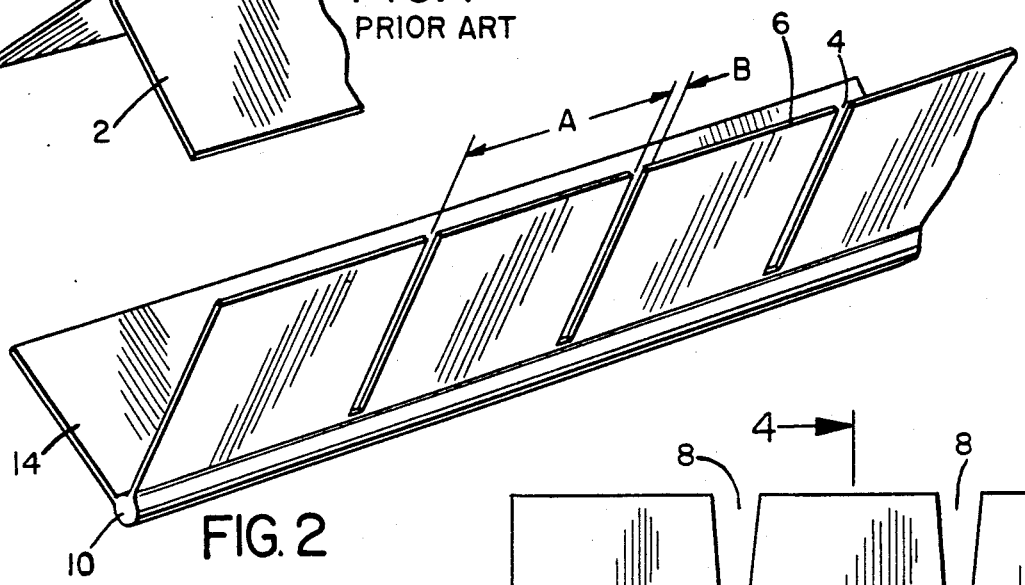
FIG. 2 is a perspective view of a portion of a corner reinforcement bead according to the present invention.
Figure 3:
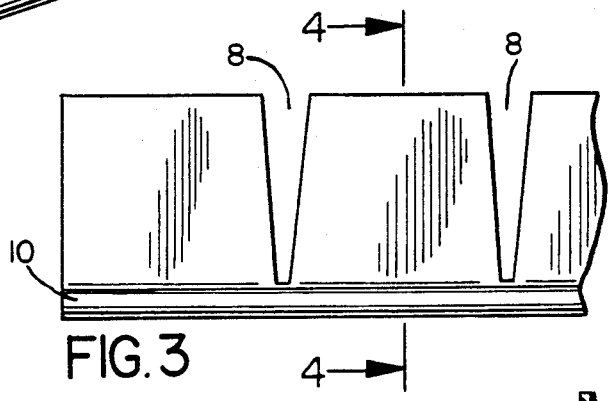
FIG. 3 is a side elevation view showing an alternative kerf configuration.

FIG. 2 depicts the general structure of the arch corner bead contemplated by this invention. It can be seen that one of the legs is segmented by spaced kerfs 4, creating tabs 6 for nailing or otherwise affixing the corner bead to a drywall corner. The range of spacing A of the kerfs is from ¼" to 2", with a preferred range of from ¼" to 1 ¼". It is also obvious that the kerfs can be either cut straight or tapered inward to the bead. The straight kerfs can vary in width B in the range from 1/64" to ⅜". FIG. 3 shows an alternate kerf configuration 8 where the kerf tapers from ½" at the wide end to 1/16" adjacent to the bead. This tapered kerf embodiment is advantageous in forming tight outside curves, although such curves are not as frequently found in practice.

In FIGS. 2 and 3, the unkerfed leg 14 is disposed horizontally from the bead and substantially perpendicular to the kerfed leg shown. It can also be seen that the bead 10 is raised and overarches the junction of the legs. This feature is better demonstrated in the cross sectional view in FIG. 4.

Figure 4:
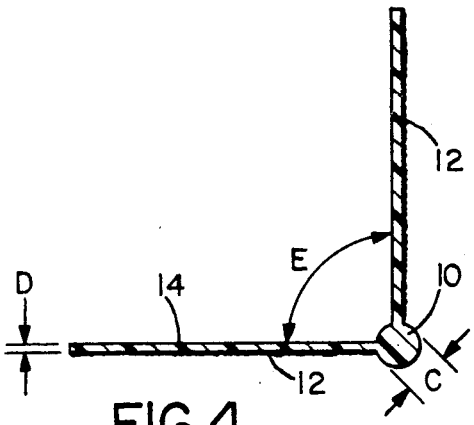
FIG. 4 is an enlarged sectional view taken on line 4—4 of FIG. 3.
Figure 5:
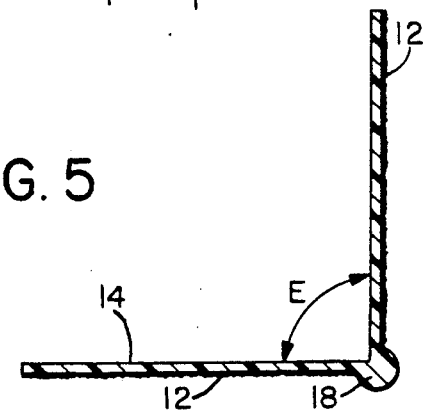
FIG. 5 is a sectional view similar to FIG. 4, showing an alternative corner reinforcement bead.

Referring now to FIG. 4, which is a cross sectional view of an arch corner bead, the relationship of bead to legs is readily visualized. An overarching of the outside angle by the solid bead formed by the legs is seen, as well as a raised bead or interior arch in the inside angle. The relative dimensions of bead diameter C to leg width D is demonstrated here, and generally falls in the range of 1.5-1 to 4.5-1, with a preferred ratio for C:D of 3:1. The embodiment shown in FIGS. 4 and 5 would require angle E to be slightly less than 90°, preferably 85°-88°.

An additional feature demonstrated in this cross sectional view is a special treatment of the outside surface 12 of the legs for the purpose of providing a surface suitable for adhesion to joint compound.

Figure 6:
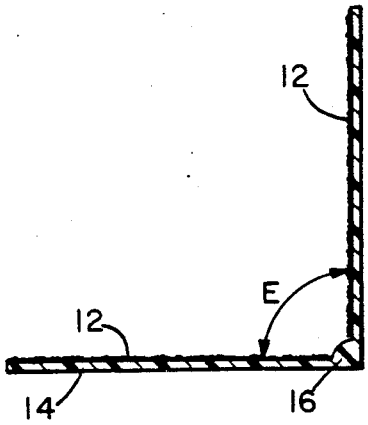
FIG. 6 is a similar view showing a further type of corner reinforcement bead.
Figure 7:
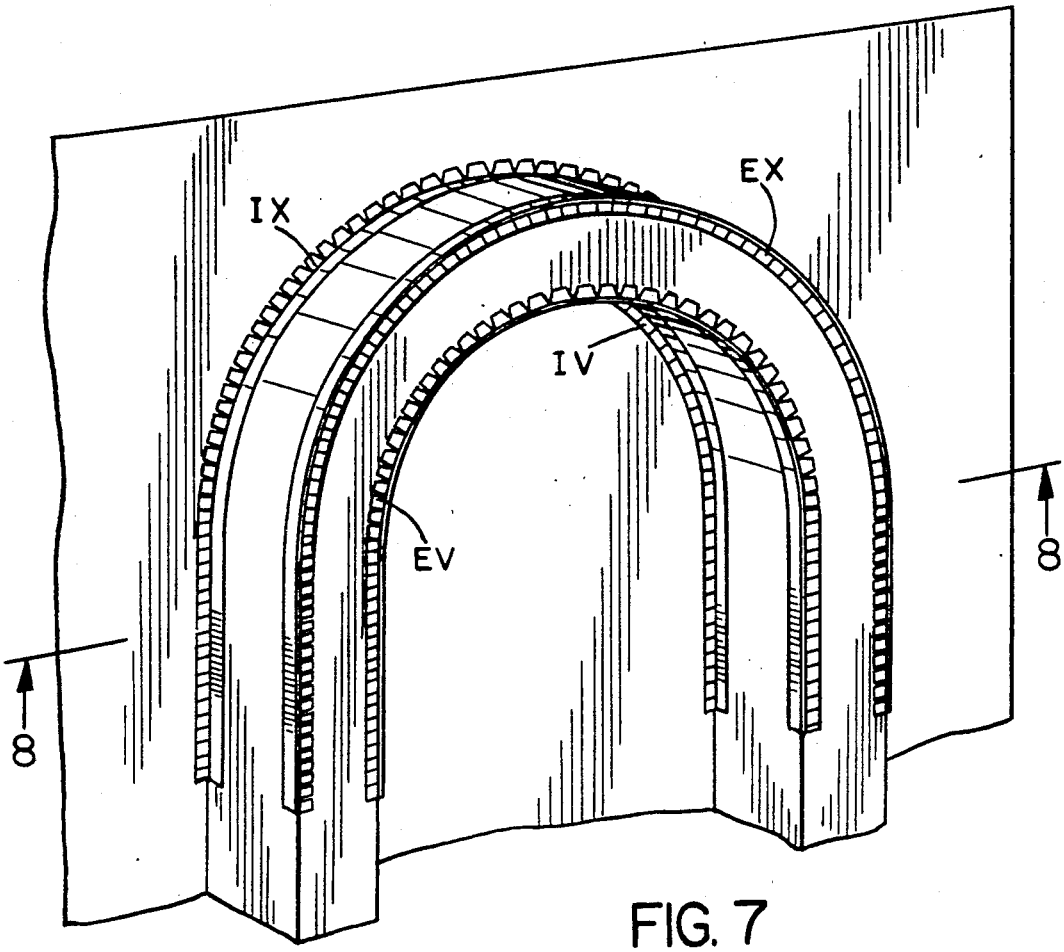
FIG. 7 is a perspective view showing multiple different uses of the corner bead on an arch structure.

FIG. 7 is a perspective view showing multiple different uses of the arch corner head on an arch structure. It shows an internal concave IV arch, with tabs radiating inward without overlapping, kinking or buckling. In this case, an embodiment containing tapered kerfs 8, as shown in FIG. 3, would be most advantageous, allowing formation of even the tightest curves. Also, where the arch is inset into a wall and not forming a thruway, an internally raised bead 16, as shown in FIG. 6, would be most suitable. In this situation, E would be slightly more than 90°, preferably 92°. The specially textured surface 12 of this strip would be on the inside surfaces.

FIG. 7 also demonstrates the ability of the arch corner bead to reinforce an external concave EV corner of an arch, where the tabs 6 radiate away from the center. This ability is restricted only by the flexibility of the solid bead. The arch corner bead is fastened to the substructure by nailing, screwing or otherwise fastening the unkerfed leg 14, and then the tabs 6. In this case, the embodiments shown in FIGS. 4 and 5, where the solid bead is raised on the outside of the angle, would be best. The internal angle E is slightly less than 90°, preferably 85°-88°.

Similarly, the radius of the external convex arch EX is restricted by the width of kerfs and their number per unit length of corner bead. Here again, the tapered kerf 8 (FIG. 3) is most suitable.

Another configuration shown in FIG. 7 is the internal convex arch IX. The bead and surface embodiment of FIG. 6 is most suitable here.

Figure 8:
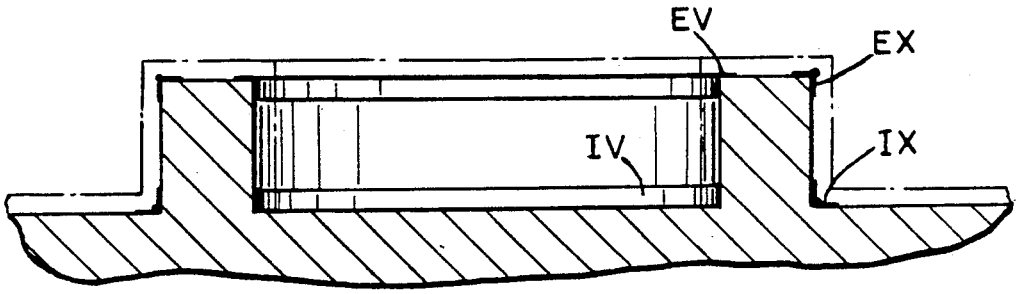
FIG. 8 is a sectional view taken on line 8—8 of FIG. 7.

FIG. 8, a sectional view taken on line 8—8 of FIG. 7, shows the internal/external position of the solid bead in the various situations described above.

Figure 9:
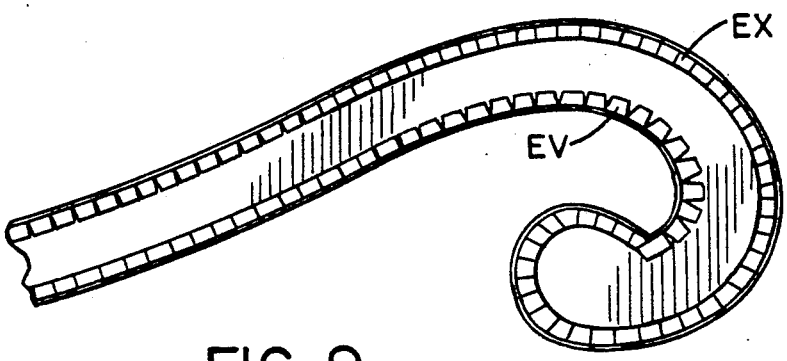
FIG. 9 illustrates the application of the corner bead to a scroll type element.

FIG. 9 illustrates the application of the arch bead in a scroll type element showing the ability of the arch corner bead contemplated by this invention to conform to curves with varying radii. External convex EX and external concave EV curves are shown. Such a structure might be found, for example, in a low wall adjacent to a curved staircase.

Figure 10:
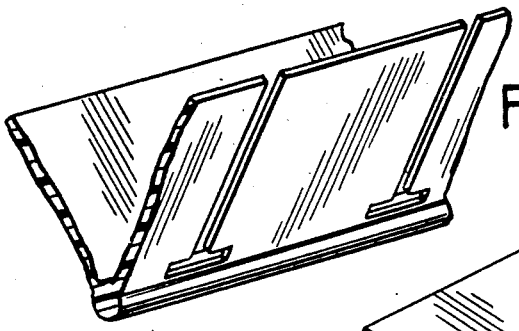
FIG. 10 is a perspective view of a portion of a corner reinforcement beam showing an alternate embodiment.

Additional flexibility is provided in the embodiment illustrated in FIG. 10. A "T"-cut is made at the base of each kerf 4 into the adjacent tabs 6 allowing the tabs to bend and conform more readily to curves, and to disburse stress on the bead. A triangular cut made at the base of each kerf 4, with the base of the triangle adjacent to the bead 10, provides the same result.

The arch corner bead described above is preferentially manufactured by extruding an elongated "L" shaped plastic strip having its two flat legs joined to form an acute inside angle, and a substantially cylindrical solid bead which is continuous with the legs at the junction of the angle formed. The plastic can be, but is not limited to acrylonitrile-butadiene-styrene (ABS) polymers, high impact styrene (HIS), or any other flexible plastic which is resistant to tearing. Numerous spaced kerfs are made in one of the legs, allowing the strip to follow curves in architectural arches without buckling, tearing or overlapping. These kerfs can be made by stamping the extruded strip, cutting with a saw or shearing tool, or in any of a number of other ways known to those skilled in the art. A surface, which allows joint compound to adhere to the strips, is put on simultaneously during the extrusion process, or after extrusion by means such as abrasion or other means of texturing also known to those skilled in the art.

Figure 11:
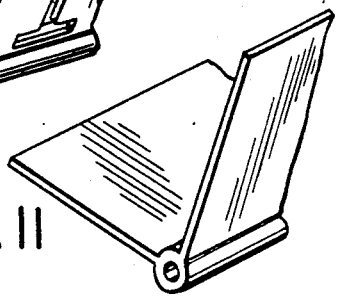
FIG. 11 is a perspective view showing an alternate embodiment with a hollow bead.

FIG. 11 shows an alternate embodiment relating to manufacture, where the bead 20 is hollow through its entire length. The narrow opening allows uniform, controlled cooling following extrusion which, in turn, produces uniform tensile strength and greater flexibility along the length of the bead.

The beaded drywall corner strip, with its kerfs and specially textured surface, can also be made by molding rather than extrusion.

EXAMPLE 1

In an arched doorway or window opening, the arch corner bead described above and shown in FIG. 2 is applied in a manner where the unkerfed leg 14 follows the circumference inside of the arch along the curving substructure. This is made possible, without kinking, stretching or tearing, by the other leg, which is repeatedly kerfed. The continuous leg 14 inside the curve is nailed, screwed or otherwise affixed to the substructure inside of the arch while applying pressure to the bead to conform to the curvature. The tabs 6 formed by kerfing radiate away from the curve of the arch and are also affixed to the drywall along the flat surface of a wall. After the arch corner bead is in place, joint compound is applied to the surfaces of the corner formed, including the specially textured surface 12 of the corner bead, and is blended with the drywall by featheredging.

EXAMPLE 2

On rarer occasions, where the architectural design calls for reinforcing an outside curving arch, the arch corner bead is applied in a similar fashion, except that the unkerfed leg follows the curve along the outside of the arch and is affixed to the substructure thereof, while the tabs formed by kerfing radiate inward toward each other along the flat drywall surface. The number of kerfs and their width determine how tight a curve can be made without overlapping. Here, the embodiment containing tapered kerfs is especially beneficial.

Although the present invention has now been described in terms of certain preferred embodiments, and exemplified with respect thereto, one skilled in the art will readily appreciate that various modifications, omissions and substitutions may be made without departing from the spirit thereof. It is intended, therefore, that the present invention be limited solely by the scope of the following claims.

I CLAIM:

1. A beaded drywall corner strip suitable for reinforcing corners of arches, comprising:

an elongated "L" shaped plastic strip having two flat legs, said legs joined forming an acute inside angle;

a substantially cylindrical solid bead formed in continuum with said legs at the junction of said angle;

one of said legs containing a plurality of spaced kerfs, said kerfs providing a means for the strip to follow curves without buckling, tearing or overlapping; and the outside surface of said legs having surface means to adhere to joint compound.

2. A drywall corner strip as described in claim 1, wherein said kerf forms an inside arch.

3. A drywall corner strip as described in claim 1, wherein said kerf forms an outside arch.

4. A drywall corner strip as described in claim 1, wherein said kerf extends to said bead.

5. A drywall corner strip as described in claim 1, wherein said kerf ends before said bead.

6. A drywall corner strip as described in claim 1, wherein said kerf tapers inward towards said bead.

7. A drywall corner strip as described in claim 1, wherein spacing of said kerfs is in the range from ¼" to 2".

8. A drywall corner strip as described in claim 1, wherein the preferred spacing of said kerfs is in the range form ¼" to 1 ¼".

9. A drywall corner strip as described in claim 1, wherein said kerf width is in the range of from 1/64" to ⅜".

10. A drywall corner strip as described in claim 1, wherein said kerfs have a broadened extension adjacent to said bead.

11. A drywall corner strip as described in claim 1, wherein the ratio of the diameter of said bead to the thickness of said leg is in the range of from 1 to 3.

12. A drywall corner strip as described in claim 1, wherein said plastic material comprises acrylonitrile-butadiene-styrene (ABS) polymers.

13. A drywall corner strip as described in claim 1, wherein said plastic material comprises high impact styrene (HIS).

14. A drywall corner strip as described in claim 1, wherein said bead overarches said junction and is in continuum with said legs.

15. A drywall corner strip as described in claim 1, wherein said bead is raised in said inside angle and in continuum with said legs.

16. A drywall corner strip as described in claim 1, wherein said acute inside angle formed by said legs is in the range from 80° to 90°.

17. A drywall corner strip as described in claim 1, wherein the preferred said acute inside angle is 85°–88°.

18. A process of making a beaded drywall corner strip suitable for reinforcing corners of arches, comprising the steps of:

extruding an elongated "L" shaped plastic strip having two flat legs, said legs joined forming an acute inside angle, and a substantially cylindrical solid bead in continuum with said legs at the junction of said angle;

cutting a plurality of spaced kerfs in one of said legs, said kerfs providing a means for the strip to follow curves without buckling, tearing or overlapping; and providing surface means to adhere to joint compound on the outside surface of said legs.

19. A process as described in claim 18, wherein the beaded drywall corner strip is made by molding rather than extrusion.

20. A process as described in claim 18, wherein said bead is hollow.

* * * * *

US005048247A

REEXAMINATION CERTIFICATE (2219th)

United States Patent [19]

Weldy

[11] B1 5,048,247

[45] Certificate Issued Feb. 15, 1994

[54] ARCH CORNER BEAD

[76] Inventor: Michael D. Weldy, 1320 Dewey Pl., Campo, Calif. 92006

Reexamination Request:
No. 90/002,806, Aug. 5, 1992

Reexamination Certificate for:

| | |
|---|---|
| Patent No.: | **5,048,247** |
| Issued: | **Sep. 17, 1991** |
| Appl. No.: | **436,073** |
| Filed: | **Nov. 13, 1989** |

[51] Int. Cl.[5] ..... E04F 19/02; B32B 1/04; B32B 3/26

[52] U.S. Cl. ..... 52/255; 52/288; 52/417; 52/717.03; 52/717.05; 264/177.17; 428/61; 428/156; 428/174; 428/188

[58] Field of Search ..... 52/255-257, 52/717.03, 717.05, 288

[56] References Cited

U.S. PATENT DOCUMENTS

| | | | |
|---|---|---|---|
| 168,207 | 9/1875 | Atherton . | |
| 1,449,745 | 3/1923 | Clapp . | |
| 1,988,739 | 1/1935 | Jones | 72/121 |
| 2,274,662 | 3/1942 | Briggs et al. | 72/121 |
| 2,311,345 | 2/1943 | Mitchell | 52/255 |
| 3,008,273 | 11/1961 | Widin | 50/60 |
| 3,201,908 | 8/1965 | Arnold | 52/255 |
| 3,255,561 | 6/1966 | Cable | 52/255 |
| 4,313,991 | 2/1982 | Lamb | 428/131 |
| 4,912,899 | 4/1990 | Plasker et al. | 52/241 |

FOREIGN PATENT DOCUMENTS

| | | | |
|---|---|---|---|
| 392025 | 9/1965 | Switzerland . | |
| 2056523 | 3/1981 | United Kingdom | 52/255 |

*Primary Examiner*—Michael Safavi

[57] ABSTRACT

An elongated "L" shaped plastic drywall corner strip containing two flat legs joined to form an acute angle, one of which is kerfed repeatedly to increase flexibility and allow installation over inside and outside arches, the outside of the legs having a surface to which joint compound adheres, and a solid bead overarching and/or interior arching the point of junction of the legs.

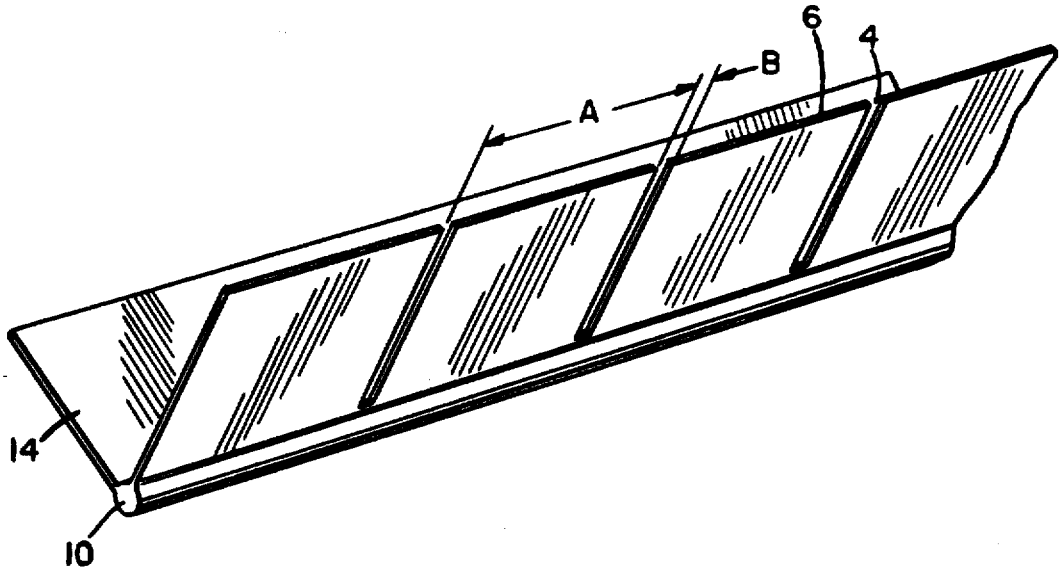

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 18–20 are cancelled.

Claims 2–17 are determined to be patentable as amended.

New claims 21–25 are added and determined to be patentable.

2. A drywall corner strip as described in claim [1] *21*, wherein said [kerf] *strip* forms an inside arch.

3. A drywall corner strip as described in claim [1] *21*, wherein said [kerf] *strip* forms an outside arch.

4. A drywall corner strip as described in claim [1] *21*, wherein said kerf extends to said bead.

5. A drywall corner strip as described in claim [1] *21*, wherein said kerf ends before said bead.

6. A drywall corner strip as described in claim [1] *21*, wherein said kerf tapers inward towards said bead.

7. A drywall corner strip as described in claim [1] *21*, wherein spacing of said kerfs is in the range from ¼" to 2".

8. A drywall corner strip as described in claim [1] *7*, wherein the [preferred] spacing of said kerfs is in the range [form] *from* ¼" to 1¼".

9. A drywall corner strip as described in claim [1] *21*, wherein said kerf width is in the range of from 1/64" to ⅛".

10. A drywall corner strip as described in claim [1] *21*, wherein said kerfs have a broadened extension adjacent said bead.

11. A drywall corner strip as described in claim [1] *21*, wherein the ratio of the diameter of said bead to the thickness of said leg is in the range of from 1 to 3.

12. A drywall corner strip as described in claim [1] *21*, wherein said plastic material comprises acrylonitrile-butadiene-styrene (ABS) polymers.

13. A drywall corner strip as described in claim [1] *21*, wherein said plastic material comprises high impact styrene (HIS).

14. A drywall corner strip as described in claim [1] *21*, wherein said bead over-arches said junction and is in continuum with said legs.

15. A drywall corner strip as described in claim [1] *21*, wherein said bead is raised [in] *inside* said [inside] angle and in continuum with said legs.

16. A drywall corner strip as described in claim [1] *21*, wherein said [acute inside] angle formed by said legs is in the range from 80° to 90°.

17. A drywall corner strip as described in claim [1] *16*, wherein [the preferred] said [acute inside] angle is 85° to 88°.

*21. A beaded drywall corner strip suitable for reinforcing the corners of arches, comprising:*

*an elongated plastic strip having two flat legs extending side-by-side lengthwise along the strip at an angle of no more than 90° to one another;*

*a corner joint connecting the legs together at the junction of the angle along adjacent side edges of the legs, the corner joint comprising a substantially cylindrical solid bead;*

*one of said legs having a plurality of spaced kerfs comprising means for allowing the strip to follow curves;*

*the legs having no openings apart from said kerfs; and*

*the outside surface of said legs having surface means to adhere to joint compound.*

*22. The strip as claimed in claim 21, wherein the bead is of cylindrical shape.*

*23. A beaded drywall corner strip suitable for reinforcing the corners of arches, comprising:*

*an elongated plastic strip having two flat legs extending side-by-side lengthwise along the strip at an angle of no more than 90° to one another;*

*a corner joint connecting the legs together at the junction of the angle along adjacent side edges of the legs, the corner joint comprising a substantially cylindrical solid bead;*

*one of said legs having a plurality of spaced kerfs comprising means for allowing the strip to follow curves;*

*each kerf having spaced parallel side edges; and*

*the outside surface of said legs having surface means for adhering to joint compound.*

*24. A beaded drywall corner strip for reinforcing the corners of arches, comprising:*

*an elongated plastic strip having two flat legs joined together along adjacent side edges to form a corner junction, said legs being inclined at an angle to one another and having inner and outer faces;*

*an elongated, substantially cylindrical solid bead formed in continuum with said legs at said corner junction;*

*said bead having an arcuate outer surface on the outside of said corner junction, and an indented angular surface on the inside of said corner junction having substantially perpendicular portions each forming a substantially continuous surface with a respective one of said leg inner surfaces;*

*one of said legs having a plurality of spaced kerfs, said kerfs providing a means for the strip to follow curves without buckling, tearing or overlapping; and*

*the outer surfaces of said legs having surface means for adhering to joint compound.*

*25. A beaded drywall corner strip suitable for reinforcing corners of arches, comprising:*

*an elongated plastic strip having a corner junction and two flat legs extending at an angle to one another from said corner junction;*

*a substantially cylindrical solid bead formed in continuum with said legs at said corner junction;*

*one of said legs having a plurality of spaced kerfs, said kerfs providing a means for the strip to follow curves without buckling, tearing or overlapping, each kerf having side edges spaced a predetermined distance apart and an inner end edge adjacent said bead extending transversely between the inner ends of said side edges; and*

*the outside surface of said legs having surface means to adhere to joint compound.*

* * * * *